US007650706B2

(12) United States Patent
Wartel et al.

(10) Patent No.: US 7,650,706 B2
(45) Date of Patent: Jan. 26, 2010

(54) SECURING DEVICE

(75) Inventors: Stéphane Wartel, Brussels (BE); Sascha Desaever, Oostduinkerke (BE)

(73) Assignee: AZOR, Brussels (BE)

( * ) Notice: Subject to any disclaimer, the term of this patent is extended or adjusted under 35 U.S.C. 154(b) by 213 days.

(21) Appl. No.: 10/595,037

(22) PCT Filed: May 17, 2004

(86) PCT No.: PCT/EP2004/050827

§ 371 (c)(1),
(2), (4) Date: Jan. 9, 2006

(87) PCT Pub. No.: WO2005/013747

PCT Pub. Date: Feb. 17, 2005

(65) Prior Publication Data

US 2006/0168850 A1 Aug. 3, 2006

(30) Foreign Application Priority Data

Jul. 10, 2003 (BE) ..... 2003/0399

(51) Int. Cl.
*A43B 23/26* (2006.01)
*A43C 7/00* (2006.01)

(52) U.S. Cl. ..... 36/54; 36/136; 24/712.3

(58) Field of Classification Search ..... 36/54, 36/136; 24/712.2, 712.3
See application file for complete search history.

(56) References Cited

U.S. PATENT DOCUMENTS

| | | | | | |
|---|---|---|---|---|---|
| 2,175,962 | A | * | 10/1939 | Kenifick | 24/128 |
| D270,779 | S | * | 10/1983 | Steinberg | D2/978 |
| 4,553,293 | A | * | 11/1985 | Blum | 36/50.1 |
| 5,042,119 | A | * | 8/1991 | Williams | 36/50.1 |
| 5,170,573 | A | | 12/1992 | Clinch | |
| 5,778,500 | A | * | 7/1998 | Illingworth | 24/712.3 |
| 6,295,704 | B1 | | 10/2001 | Rivas | |
| 6,338,186 | B1 | * | 1/2002 | Kleinmann | 24/712.2 |
| 2002/0083620 | A1 | | 7/2002 | Geiwald et al. | |
| 2004/0006856 | A1 | * | 1/2004 | Moreno | 24/712.3 |

FOREIGN PATENT DOCUMENTS

| | | |
|---|---|---|
| CA | 2246463 | 3/2000 |

* cited by examiner

*Primary Examiner*—Ted Kavanaugh
(74) *Attorney, Agent, or Firm*—Sughrue Mion, PLLC

(57) ABSTRACT

The invention concerns a securing device in the form of a strip (1) in open position, arranged to cover exclusively a shoe (4) lace (3) and comprising means to be fixed to said shoe (4) and a series of holes (2) for passing through the lace (3). The device is adapted to be folded down such that the left side is fixed to the right side. Moreover, the length of said securing device (1) is substantially perpendicular to the axial direction of the shoe (4).

11 Claims, 3 Drawing Sheets

SECURING DEVICE

Device for preventing laces coming undone in the form of a band in the open position, arranged to cover a shoe lace and comprising a left-hand end and a right-hand end, means of fixing to the said shoe a series of orifices for the lace to pass, the said device being designed to be folded down so that the left-hand end is fixed to the right-hand end when it is in the closed position by mutual fixing means.

BACKGROUND OF THE INVENTION

It has often been observed on laced shoes, whether they have a high or low tongue, that the knot and/or loop of the lace frequently comes undone, for example when playing sport, when handling children after having tied the lace, when the lace accidentally hooks onto something; or when the lace has a relatively inflexible texture (for example made from leather or nylon).

Such unwanted undoing is not only a nuisance, because of the knots and loops that it is constantly necessary to re-do, but may in particular be a source of incidents and accidents, more particularly with children, who risk walking on their laces and falling.

The same applies with sportspersons, who may fall because of an undone lace during a match or race, with cyclists and with motorcyclists, where this coming undone may even put their life in danger.

Amongst workers on sites who are working with machines and/or at a height the coming undone may give rise to serious accidents (or even death).

Many devices for preventing laces coming undone have been developed during the past few years, for example the device for preventing undoing disclosed in the patent U.S. Pat. No. 4,780,936, but the majority of them cover the knot and not the loops of the knot. Consequently they do not resolve the problem of the loops of the knot catching. In addition they fall off as soon as the lace is untied, for example when taking the shoe off.

The U.S. Pat. No. 5,042,119 discloses a device for securing, covering and containing the ends of the laces. It consists of a band of cloth in three parts, the central part of which is fixed, in particular stitched over the whole length of the shoe, to the part corresponding to the instep. In order to completely cover the knotted lace, the invention described in the U.S. patent comprises two foldable parts which are superimposed over the entire length of the instep and which are attached to each other, for example by a zip or other similar means. This therefore procures a kind of case which completely surrounds the knot and the lace loops and which covers the entire top of the shoe.

The drawback of such a device is that it is not simple to manufacture nor to position, the stitching of the central part having to be carried out on a shoe already partly stitched, the device leaving no freedom of movement since it imposes a certain degree of rigidity, and in particular such a device cannot be adapted to all shoes, for various reasons. First of all, this type of bulky device cannot be conceived on a town shoe nor even on a mixed shoe. It can only be conceived for sports shoes related to disciplines in which the foot remains relatively fixed, for example for cycling shoes. In addition, for one and the same shoe, the device is not very flexible with regard to the width and causes additional discomfort for an athlete with large feet. This is because the passage holes for the laces fit on the top of the foot and the separation between the holes is not variable but is limited by the width of the central part.

SUMMARY OF THE INVENTION

The aim of the invention is to mitigate the drawbacks of the prior art by procuring an invention that is simple to manufacture and to position, allowing flexibility of movement, which is adaptable to any type of shoe and to any width of foot, and which can be used alike for town shoes, working shoes or mixed or sports shoes, but also to shoes for sporting disciplines in which the movement of the foot plays a very important role.

To resolve this problem, a device is provided according to the invention as indicated at the start whose length is substantially perpendicular to the axial direction of the shoe and which is designed, when it is in the closed position, to only partially cover the lace, in particular partially the loops of a lace knot, when the latter is tied.

This therefore constitutes a simple but particularly innovative device, preventing the lace knots from coming undone unexpectedly and preventing the knot loops from catching, whilst being adaptable to shoes already on the market, capable also of equipping, in a fixed or removable fashion, future shoes.

Apart from comfort, the invention also affords safety and a fashionable appearance, a means of promotion and/or advertising; with all kinds of logos, shapes, colours, materials etc.

This device makes it possible to maintain the flexibility of the shoe, which may often prove necessary for the sporting discipline, and in addition its small size simplifies manufacture, and the design of the device according to the invention provides a reduced fitting, closing and opening time.

Advantageously, the means of mutual fixing of the said left-hand side of the lace covering device to the right-hand side are mutual self-gripping means. In this way, the opening and closing of the device according to the invention is simplified.

In a particular embodiment, the series of lace passage orifices comprises several lace passage orifices. When several orifices are present in the device according to the invention, passing the lace through more than one orifice affords impeccable holding of the device in the closed position (no rotation).

The device according to the invention preferably comprises at least one lace passage orifice in the said series that is in the form of a slit.

Having only one or several orifices in the form of a slit simplifies further the manufacture and fitting of this.

The invention advantageously also comprises a series of lace passage orifices where two orifices are in the form of a slit and two orifices are substantially circular, the said slits being situated one above the other parallel to a long side of the said lace-covering device, the two substantially circular orifices being situated in particular on each side of the two slots with respect to the said long side of the said device. The presence of the four lace passage orifices in the said series, where two are in the form of a slit and two are substantially circular, makes it possible to better position the device on the shoe, provides better holding and prevents the rotation thereof. In addition, the user can tie his laces in a "straight" or "crossed" fashion.

In a particularly advantageous embodiment of the device according to the invention, the band is formed by a piece made from leather, textile, flexible plastics material, articulated metal or any deformable material in order to bring the band into its closed position.

In addition, in a particular embodiment, the said means of fixing the said device to the shoe consist of the said lace. This enables the device to be removable and to be able to be transposed from one shoe to another, and in addition this characteristic makes it possible to adapt the device according to the invention to any width of shoe, since consequently the device will be positioned at variable distances from the lace passage orifices in the shoe.

The term "flexible band" as used here means any substantially planar part of the material having a thickness, with a relatively elongate shape, this comprising for example a rectangle, trapezium, ellipse, etc.

The device according to the invention preferably has a length of between 5 cm and 10 cm, and more particularly 6.5 cm, and a width between 1 cm and 5 cm, preferably approximately 2 cm or approximately 4.5 cm according to the model.

Other embodiments of the device according to the invention are indicated in the accompanying claims.

Another object of the invention is an assembly comprising:

the device for preventing laces coming undone a laced shoe comprising a rectangular-shaped tongue and a lace.

This assembly is characterised in that the device for preventing laces coming undone is an integral part of the tongue of the shoe. Such an embodiment has the advantage that there is never any risk of the user losing his device for preventing laces coming undone, even when the laces are completely removed.

Advantageously, this assembly is characterised in that the device for preventing laces coming undone and the orifices are cut in at least one layer of material constituting the said tongue. This advantage simplifies the manufacture of the assembly. Other embodiments of this assembly according to the invention are indicated in the accompanying claims.

Other characteristics, details and advantages of the invention will emerge from the description given below, non-limitingly and making reference to the accompanying drawings.

DETAILED DESCRIPTION

In the figures, the identical or similar elements bear the same references.

Figure 1:
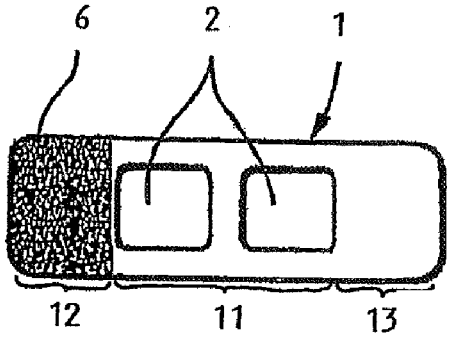
FIG. 1 is a plan view of the embodiment of the device according to the invention in the open position.

FIG. 1 illustrates the device 1 for preventing laces coming undone according to the invention. This comprises a flexible deformable band, such as for example leather, textile, plastic, nylon, etc, or a rigid changeable and/or deformable band, such as for example metal, articulated metal, aluminium, rigid plastic, etc, the materials used not being limited. It can also comprise a band in a combination of two sorts of material: a flexible part and a rigid part.

The device according to the invention is provided with means (2) of fixing to a shoe (4), close to the knot (8) and/or the loops (5) of the lace (3). This device also comprises mutual fixing means (6, 7) (hooks, self-gripping means, press studs, as well as all other kinds of closure that are possible non-limitingly), for holding it in the closed position (illustrated in FIG. 2).

The band 1 comprises a central part 11 and two ends 12 and 13. In the case of the "self-gripping" system, one of the ends 12 of the band 1 comprises fibres in a loop 6, whilst the other end is provided with hooks 7 gripping in the looped fibres. This makes it possible to obtain a folding over of the sheath type trapping the said loops 5.

Figure 2:
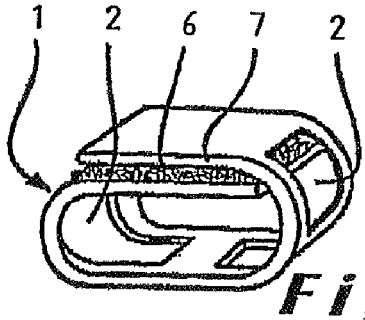
FIG. 2 is a perspective view of the device according to FIG. 1 in the closed position.

The band 5 can be brought into a flat state (open position) as can be seen in FIG. 1, or in a folded over state (closed position) as can be seen in FIG. 2.

The device according to the invention 1 can be produced from all materials, in particular leather, imitation (simulated) leather, textile, nylon, flexible and/or rigid plastics material, articulated metal, aluminium, and all other non-limiting materials.

The device according to the invention preferably has a length in between 5 cm and 10 cm, and more particularly approximately 6.5 cm, and a width of between 1 cm and 5 cm, preferably approximately 2 cm or approximately 5 cm according to the model.

The material will be chosen according to the targeted use and/or the aesthetic effect sought, so that it can have a texture or colour identical to or different from those of the tongue 9 of the shoe 4 proper, even if the band 1 is incorporated in the tongue 9 of the shoe (4).

It may comprise decorative patterns, logos, advertising, etc, in particular when an aesthetic, promotional, advertising or other effect is sought, or in order to obtain an effect for identifying or making the shoes stand out.

In luxury articles, the band 1 can be produced from articulated metal like bracelets in order to obtain a luxury appearance, compatible with the character of certain top of the range shoes.

The invention is therefore not limited to the embodiments described in this document, for which it is possible to provide other forms, other textures, or even other means of fixing to the shoe, without departing from the scope of the invention.

The essential point is that the band can pass from a flat position, that is to say from its open position (FIG. 1), to a folded-down position that is to say to its closed position (FIG. 2), and vice a versa, without the least difficulty and that this operation can be renewed, without appreciable risk of damage.

In the example illustrated in FIG. 1, the band 1 is produced in the form of a cropped leather piece having substantially the appearance of a rectangular band in which two orifices (2) of symmetrical shape have been cut.

The form and the number of these orifices 2 are not limiting and it will also be possible to provide slits, parallel or not, or circular or polygonal orifices, without at all changing the principle of the invention, the essential point being that the band (FIG. 1) can be fixed to the shoe 4, in this first embodiment, by means of the lace 3.

Figure 3:
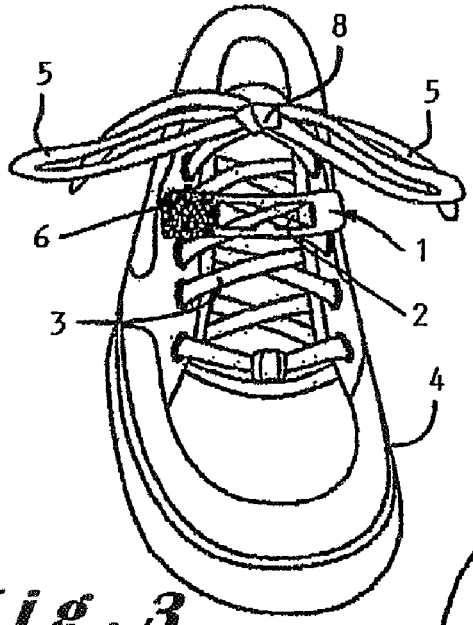
FIG. 3 is a perspective view of the device according to FIG. 1 in the open position placed on a shoe.

As illustrated in FIG. 3, this band 1 is in fact attached to the lace 3 of the shoe 4 simply by passing the two lengths of the lace 3 through each of the two orifices (2) in the band, during lacing.

According to a preferential embodiment, the band i is directly fixed to the shoe 4 and/or to the tongue 9 of the footwear article 4 by means of the lace 3, and for this purpose comprises fixing means, in particular the orifices 2 each receiving the two lengths of the lace.

This first embodiment is more particularly intended to equip footwear articles already on the market, since the band 1 is self-contained and can easily be associated with the lace 3 of a shoe 4, without its being necessary to make any modification or addition to these commercially available footwear articles 4.

Figure 4:
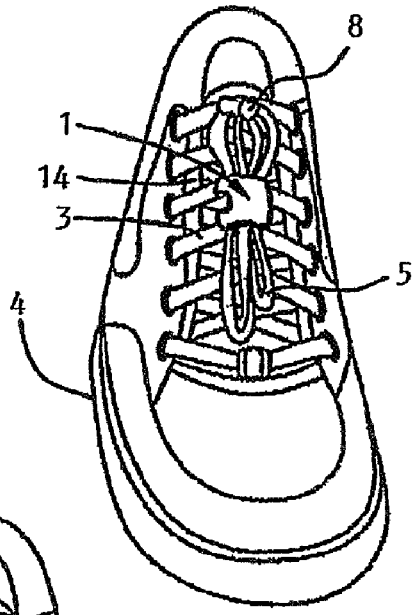
FIG. 4 is a perspective view of the device according to FIG. 1 in the closed position placed on the central part of a shoe.

It suffices to lace the lace 3 up to the last eyelets, situated at the top of the quarters, to tie the footwear article 4 by means of a knot 8 and/or a loop 5, and then, as can be seen in FIG. 4, to bring the loops 8 of the knot 8 of the lace 3 onto the band 1 and finally to hold down the band 1 in order to bring it in the form illustrated in FIG. 2 and obtain a sheath trapping the said lace 3.

According to another embodiment, it is also permissible, particularly in the case of new manufactures, to fix the band 1 not to the lace 3 but directly to the uppers 14 of the footwear article 4, for example on the external quarter, close to the last eyelet situated at the top of the upper 14, or on the side of the upper 14, just below the opening of the footwear article 4 intended for receiving the foot, or close to the last eyelet, in order to serve both as a device for preventing laces from coming undone and as a means of promotion and/or advertising (for example with logos, decorative patterns, special shapes, etc, not limiting).

In this variant embodiment, the band 1 can be permanently fixed by stitching, or be removably coupled to the uppers, for example by hooking on, self-gripping or press studs (not illustrated).

It can obviously be envisaged that the band 1 be fixed directly to the tongue 9 of the footwear article 4, close to the knot 8 and/or the loops 5 of the lace 3, this fixing being able to be definitive (stitched, stapled, etc) or removable (press studs, self-gripping means, hooks, etc, not limiting).

Figure 5:
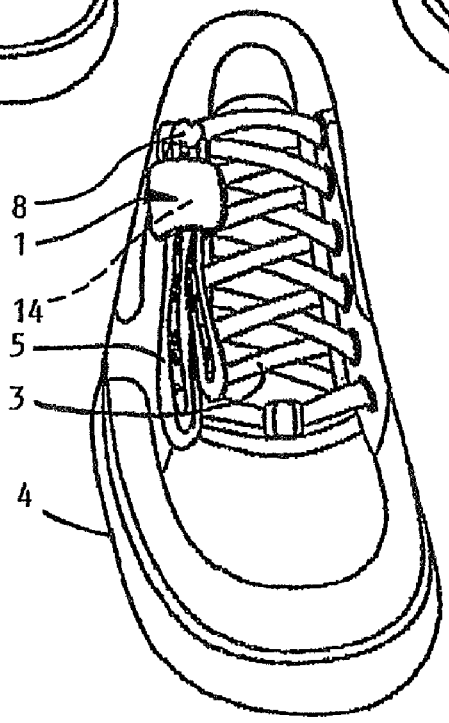
FIG. 5 is a perspective view of the device according to FIG. 1 in the closed position placed on the side of a shoe.

As can be seen in FIG. 5, the band 1 is fixed close to the knot 8 of the lace 3 so as to serve as a device for preventing the lace coming undone, after winding over the loops 5 of the lace 3.

Figure 6:
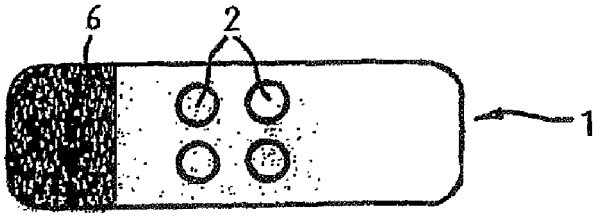
FIGS. 6, 7, 8 and 9 are other embodiments of the device according to the invention.

Various embodiments of the orifices 2 are illustrated in FIGS. 6, 7, 8, 9. FIG. 6 illustrates a band 1 comprising four substantially circular orifices 2 distributed symmetrically over the central part 1. The laces 3 can be slipped into these orifices 2 from left to right or vice versa, but also in the shape of a cross.

Figure 7A:
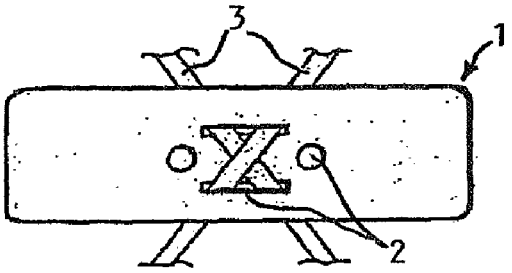
Figure 7B:
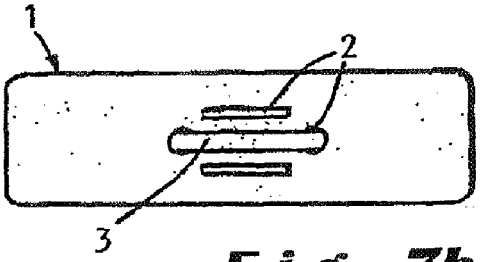

FIG. 7 illustrates a band 1 comprising four orifices 2, two of which are substantially circular and situated on each side of the other two in the form of slits distributed symmetrically on the central part 11. The laces 3 can be slipped into these orifices 2 from left to right or vice versa (FIG. 7*a*), but also in the form of a cross (FIG. 7*b*).

Figure 8A:
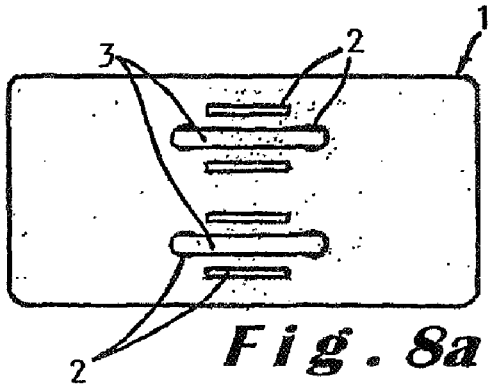
Figure 8B:
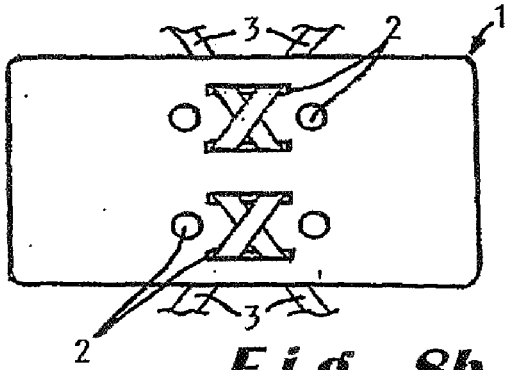

FIG. 8 illustrates a band 1 comprising, twice, the illustrated pattern of the orifices in FIG. 7. The laces 3 can be slipped into these orifices 2 from left to right or vice versa (FIG. 8*a*) but also in the form of a cross (FIG. 8*b*).

Figure 9:
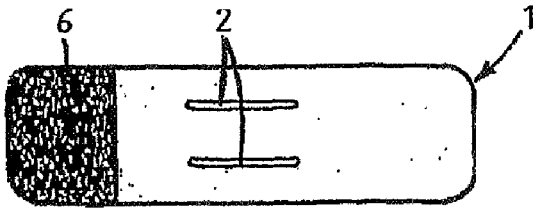

FIG. 9 illustrates a band 1 comprising two orifices 2 in the form of a slit. This design is particularly suitable for a fitting of the laces 3 in a cross.

Figure 10:
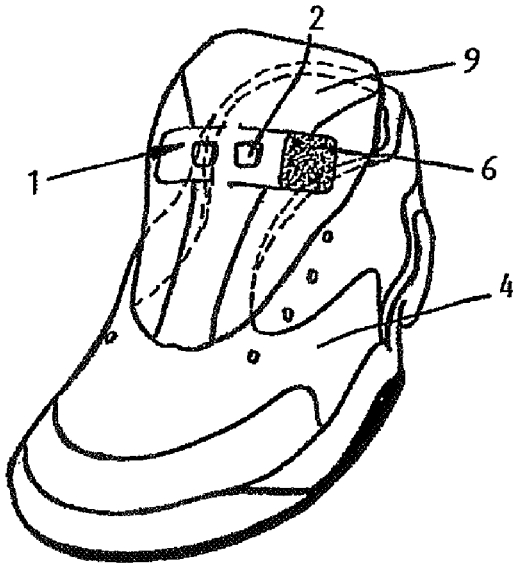
FIG. 10 is a perspective view of a particular embodiment, illustrating the device according to the invention incorporated in and/or cut in the tongue of a shoe, in which the central part of the said device forms part of the tongue and the ends of which are cut in the said tongue.
Figure 11:
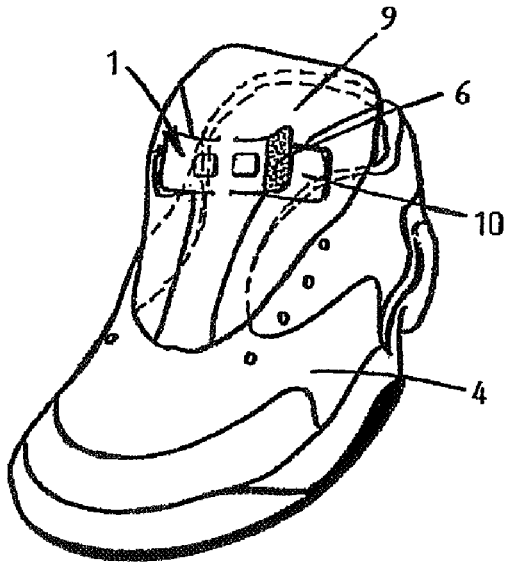
FIG. 11 is a perspective view of FIG. 10 depicting the two ends of the device according to the invention detached.

In another embodiment, the band 1 is entirely or partially cut, and therefore entirely or partially integrated (FIG. 10), in the tongue 9 of the footwear article 4. The central part 11 of the band 1 forming an integral part of the tongue 9, and thus being fixed. The two ends 12 and 13 comprise the hooking-on means 6 and 7, ends 12, 13 which can be detached (FIG. 11) from the tongue 9. The cropped ends 12, 13 are not necessarily cut through all the layers of the material constituting the said tongue 9 of the shoe 4. For example, the cutting is not begun on the last layer (the inside of the shoe) and consequently it 10 makes it possible to ensure greater strength for the tongue of the shoe.

Figure 12:
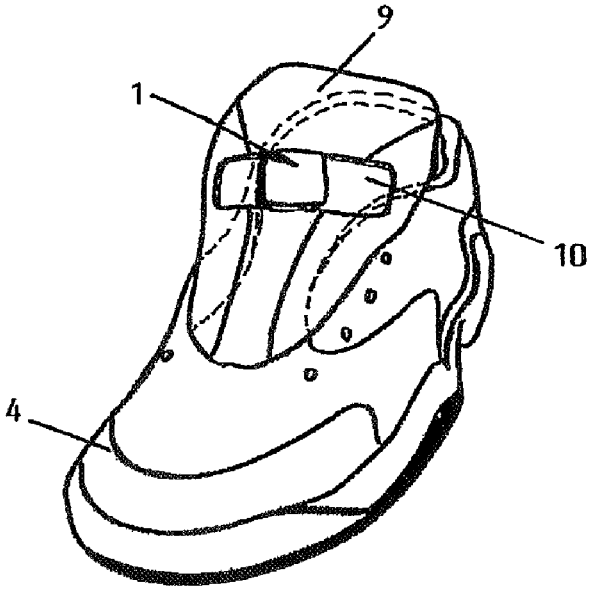
FIG. 12 is a perspective view of FIG. 10, after winding of the device according to the invention in order to partially cover the laces of a shoe.

In this way, the two ends 12, 13 of the band 1 with the mutual fixing means 6, 7 can therefore be folded down in the form of a sheath (FIG. 12) in order to hold the loops 5 of the lace 3 so long as the lace 3 has been passed through the lace-passage orifices (2).

The ends 12, 13 remain above the said tongue 9, and are therefore not integrated therein.

It suffices to pass the two lengths of the lace through the orifices 2 and to close the band 1 again so that the mutual fixing means 6 and 7 join in the form of a sheath so that the band 1 immobilises the loops 5.

One end 12, 13 of this band 1 can be attached in a fixed fashion (stitched onto or forming part of the footwear article 4) or removably (with hooks, self-gripping means, press studs etc) to the footwear article.

The other end 13, 12 can be attached to and/or hooked onto the other side of the footwear article by means of one or more hooks, self-gripping means, press studs etc.

The ends are positioned and/or attached then on each side of the instep below or between the eyelets through which the lace 3 passes, and level with the knot 8 and/or loops 5.

This device can be developed during the production of the footwear article (4), or can even be applied to shoes 4 already on the market by adding fixing means (hooks, press studs, Velcro, etc), which are to be placed on the footwear article 4, for example by stapling, perforating, attaching, etc, non-limitingly, these fixing means.

By adding attachment systems, for example on the side of the instep of the footwear article 4, or on the bottom part (for example at the sole) and possibly by extending the ends 12, 13, which can for example be made from an elastic material, the stability of the system will be increased.

The latter embodiment can be extended by adding small pockets, with or without closure, for containing therein one or more keys, one or more chips used amongst other things during sporting events (marathons, etc).

These pockets can be situated on the ends of the support, or alongside the band 1.

A rigid reinforcement (metal, plastic or other) can be added to or integrated in this support in order to guarantee the stability of the said support.

Naturally the present invention is in no way limited to the embodiments described above and many modifications can be made thereto without departing from the scope of the accompanying claims.

The invention claimed is:

1. A device, for preventing laces coming undone arranged to be placed on a shoe and to cover a lace of said shoe, in the form of a band having a length and a width, said length being greater in size than said width, said width being smaller than the length of the shoe, comprising:

a left-hand end and a fight-hand end, each comprising mutual fixing means, means for fixing said band to said shoe, and a central flat part comprising a series of orifices for the lace to pass through, said band presenting an open position where the length of the device is disposed perpendicular to an axial direction of said shoe, when said device is placed on said shoe, a closed position wherein the length of the left-hand end and the right-hand end are folded in an overlapping position one onto each other to form a sheath that is fixed to said shoe by said mutual fixing means, and wherein the band only partially covers the loops of the knot of said lace when the lace is knotted by the sheath, which has a perimeter smaller than said length of the band, and a fixed position where the device is attached to the shoe through the central flat part, said fixed position being reachable when the band is in the open position and in the closed position;

wherein the device has a length which is between 5 cm and 10 cm, and a width which is between 1 cm and 5 cm.

2. The device for preventing laces coming undone according to claim 1, characterised in that the mutual fixing means for fixing the left-hand side of the device to the right-hand side are mutual self gripping means.

3. The device for preventing laces coming undone according to claim 1, characterised in that the series of orifices comprises several orifices for the lace to pass.

4. The device for preventing laces coming undone according to claim 1, characterised in that at least one of the orifices for the lace to pass in the series is in the form of a slit.

5. The device for preventing laces coming undone according to claim 1, characterised in that it comprises a series of lace passage orifices comprising two orifices in the form of a slit and two substantially circular orifices, said slits being situated one above the other parallel to a long side of the said device for preventing laces coming undone, the two substantially circular orifices being situated in particular on each side of the two slits with respect to the said long side of the said device.

6. The device for preventing laces coming undone according to claim 1, characterised in that the device comprises a repetition of patterns of the orifices, said patterns being situated one above the other parallel to a long side of said device.

7. The device for preventing laces coming undone according to claim 1, characterised in that the length is approximately 6.5 cm, and the width is between approximately 2 cm and approximately 4.5 cm.

8. The device for preventing laces coming undone according to claim 1, characterised in that the said band is formed by a piece made from leather, textile, flexible plastics material, articulated metal or any material that is deformable in order to bring the band into its closed position.

9. The device for preventing laces coming undone according to claim 1, characterised in that the said means of fixing the said device to the shoe consist partly of the said lace.

10. An assembly, comprising the device for preventing the laces coming undone according to claim 1, and a shoe, comprising a rectangular-shaped tongue and a lace, characterised in that the device for preventing laces coming undone is an integral part of the tongue of the shoe.

11. In combination:

a shoe; and a device for preventing laces coming undone arranged to be placed on a shoe and to cover a lace of said shoe, in the form of a band having a length and a width, said length being greater in size than said width, said width being smaller than the length of the shoe, the device comprising:

a left-hand end and a right-hand end, each comprising mutual fixing means, means for fixing said band to said shoe, and a central flat part comprising a series of orifices for the lace to pass through, said band presenting an open position where the length of the device is disposed perpendicular to an axial direction of said shoe, when said device is placed on said shoe, a closed position wherein the length of the left-hand end and the right-hand end are folded in an overlapping position one onto each other to form a sheath that is fixed to said shoe by said mutual fixing means, and wherein the band only partially covers the loops of the knot of said lace when the lace is knotted by the sheath, which has a perimeter smaller than said length of the band, and a fixed position where the device is attached to the shoe through the central flat part, said fixed position being reachable when the band is in the open position and in the closed position.

* * * * *